US007747181B2

(12) United States Patent
Maeda et al.

(10) Patent No.: US 7,747,181 B2
(45) Date of Patent: Jun. 29, 2010

(54) IMAGE FORMING APPARATUS AND DETACHABLE DEVELOPER CONTAINER WITH WIRELESS COMMUNICATION THEREBETWEEN

(75) Inventors: Yuichiro Maeda, Kashiwa (JP); Kiyoshi Okamoto, Moriya (JP); Noriaki Matsui, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 11/933,748

(22) Filed: Nov. 1, 2007

(65) Prior Publication Data

US 2008/0145067 A1 Jun. 19, 2008

(30) Foreign Application Priority Data

Dec. 19, 2006 (JP) ..... 2006-341128

(51) Int. Cl.
*G03G 15/00* (2006.01)

(52) U.S. Cl. ..... 399/27; 399/261; 399/253

(58) Field of Classification Search ..... 399/8, 399/9, 12, 24, 25, 27, 94, 110, 111, 119, 399/253, 261, 262, 163
See application file for complete search history.

(56) References Cited

U.S. PATENT DOCUMENTS 6,215,974 B1 * 4/2001 Katoh et al. ..... 399/258
2006/0083564 A1 * 4/2006 Yazawa et al. ..... 399/363
2007/0237537 A1 * 10/2007 Hasegawa et al. ..... 399/81
2008/0025735 A1 * 1/2008 Odani ..... 399/12
2008/0138095 A1 * 6/2008 Wegman et al. ..... 399/12

FOREIGN PATENT DOCUMENTS

JP 2003-263022 A 9/2003

* cited by examiner

*Primary Examiner*—David M Gray
*Assistant Examiner*—G. M. Hyder
(74) *Attorney, Agent, or Firm*—Canon U.S.A., Inc., IP Division

(57) ABSTRACT

An image forming apparatus to which a developer container is detachably mountable includes a receiving unit configured to receive, via wireless communication, temperature information detected by a temperature detecting unit, which is disposed in a developer container, from the developer container in a state not mounted to the image forming apparatus. The image forming apparatus further includes a determining unit configured to determine, based on the temperature information received by the receiving unit, whether an oscillating unit disposed in the developer container is to be oscillated, and a transmitting unit configured to transmit a signal for oscillating the oscillating unit to the developer container via wireless communication based on a determination result of the determining unit indicating that the oscillating unit is to be oscillated.

11 Claims, 14 Drawing Sheets

FIG. 11

MESSAGE: TEMPERATURE OF TONER [PRODUCT SYMBOL xxxx]
CASSETTE IS TOO HIGH

IMAGE FORMING APPARATUS AND DETACHABLE DEVELOPER CONTAINER WITH WIRELESS COMMUNICATION THEREBETWEEN

BACKGROUND OF THE INVENTION

1. Field of the Invention

The present invention relates to a developer container (e.g., toner container) equipped with a wireless communication unit, such as a non-contact radio tag (e.g., an RFID (Radio Frequency Identification) tag). The present invention also relates to an image forming apparatus capable of wirelessly communicating with a developer container that is not yet mounted to the image forming apparatus.

2. Description of the Related Art

In an electrophotographic image forming apparatus, a latent image formed on a photosensitive member is developed by using a toner as a developer (developing powder). The image developed by the toner is transferred to a sheet, and the transferred toner image is fixedly formed on the sheet through a fusing process using a heating method, for example.

The toner is consumed each time printing is performed. Typically, the toner is supplied to a user while it is contained in a toner container (also called a toner cartridge, a toner bottle, or a toner pack) which can be mounted to a main body of the image forming apparatus in an easily replaceable manner. Because the toner can be adversely affected by heat, several techniques have been proposed to deal with heat affecting not only the toner container already mounted to the main body of the image forming apparatus, but also the toner container before it is mounted to the apparatus main body.

For example, Japanese Patent Laid-Open No. 2003-263022 proposes a technique of storing, as temperature history information, changes of temperature during transportation and in a storage environment for a period from the production stage of a toner cartridge to delivery to the user, and changing a time for control of toner agitation based on the temperature history information when the toner cartridge is set in an image forming apparatus. That technique is intended to change the agitation time depending on a toner state because a degree of toner condensation differs depending on the toner state during storage.

However, the technique described in Japanese Patent Laid-Open No. 2003-263022 is directed to a toner container already mounted to the image forming apparatus, and it pays no considerations to a not-yet-mounted (spare) toner container which is placed near the image forming apparatus.

Accordingly, even when the spare toner container is prepared near the image forming apparatus, a downtime is generated with the operation of agitating the toner in the toner container and the operation of replenishing the toner to the image forming apparatus when the toner container is replaced.

Further, because the toner melting point has been recently reduced in view of demands for energy saving and a higher throughput of printing, the technique proposed in Japanese Patent Laid-Open No. 2003-263022 accompanies a problem that the toner may cohere and aggregate before the toner container is mounted to the image forming apparatus. Stated another way, during a period in which the toner container is stored in a warehouse or the like, the toner container is exposed to a high-temperature environment for a long time and the toner therein is apt to cohere and aggregate. In such a case, even when the toner agitation control is performed at the time of mounting the toner container (cartridge) to the image forming apparatus, it may be difficult to restore the toner to a practically usable level.

SUMMARY OF THE INVENTION

An embodiment of the present invention is directed to reducing a downtime caused with the operation of replenishing a toner when a toner container is mounted to an image forming apparatus, and to prevent a toner from cohering and aggregating in a not-yet-mounted (spare) toner container.

According to a first aspect of the present invention, an embodiment is directed to an image forming apparatus to which a developer container is detachably mountable. The image forming apparatus includes a receiving unit configured to receive, via wireless communication, temperature information detected by a temperature detecting unit, which is disposed in the developer container, from the developer container in a state not mounted to the image forming apparatus, a determining unit configured to determine, based on the temperature information received by the receiving unit, whether an oscillating unit disposed in the developer container is to be oscillated, and a transmitting unit configured to transmit a signal for oscillating the oscillating unit to the developer container via wireless communication based on a determination result of the determining unit indicating that the oscillating unit is to be oscillated.

According to a second aspect of the present invention, an embodiment is directed to an image forming apparatus to which a developer container is detachably mountable. The image forming apparatus includes an operating unit configured to receive an operation instruction from a user, a receiving unit configured to receive, via wireless communication, temperature information detected by a temperature detecting unit, which is disposed in the developer container, from the developer container in a state not mounted to the image forming apparatus, a determining unit configured to determine, based on the temperature information received by the receiving unit, whether an alarm is to be displayed in the operating unit, and a display control unit configured to display the alarm in the operating unit based on a determination result of the determining unit indicating that the alarm is to be displayed in the operating unit.

According to a third aspect of the present invention, an embodiment is directed to a developer container detachably mountable to an image forming apparatus. The developer container includes a temperature detecting unit arranged to detect a temperature, and a transmitting unit configured to transmit, to the image forming apparatus via wireless communication, temperature information detected by the temperature detecting unit in a state that the developer container is not mounted to the image forming apparatus.

Further features of the present invention will become apparent from the following description of exemplary embodiments with reference to the attached drawings.

BRIEF DESCRIPTION OF THE DRAWINGS

FIG. 11 illustrates an alarm screen displayed in a liquid crystal display portion of an operating unit according to an embodiment.

DESCRIPTION OF THE EMBODIMENTS

First Exemplary Embodiment

Figure 1:
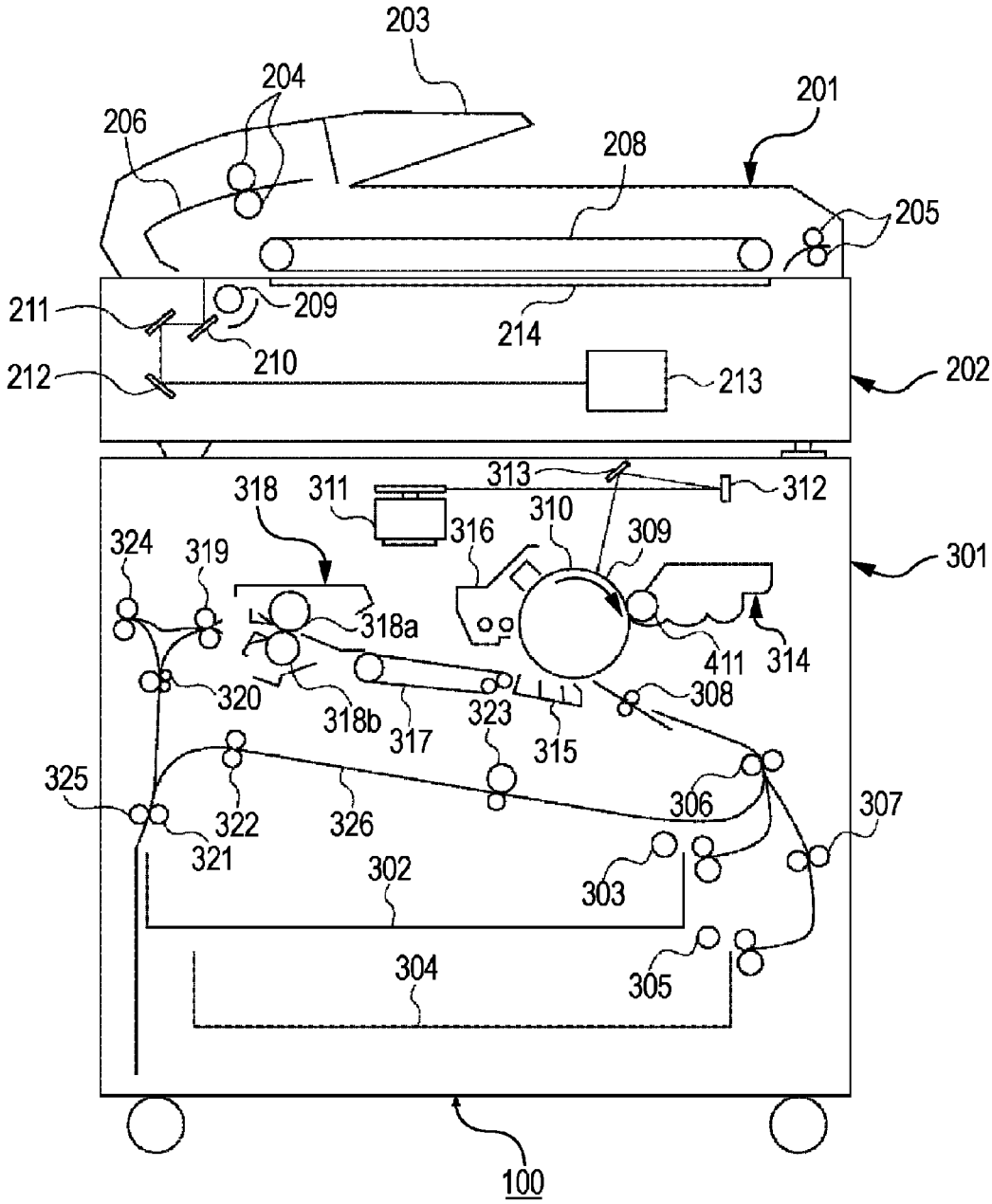
FIG. 1 is a schematic vertical sectional view illustrating the overall construction of an image forming apparatus according to an embodiment of the present invention.

A first exemplary embodiment of the present invention will be described below with reference to the drawings. FIG. 1 is a schematic vertical sectional view illustrating the overall construction of an image forming apparatus according to the first exemplary embodiment. The image forming apparatus 100 comprises a document automatic feed apparatus 201, a reading (scanning) apparatus 202, and an image reproducing apparatus 301.

In the document automatic feed apparatus 201, each of documents (not shown) placed on a document stand 203 is separated and fed by paper feed rollers 204 and is conveyed onto the reading apparatus 202 while being guided by a conveying guide 206.

Further, the document is conveyed at a constant speed by a conveying belt 208 and is ejected out of the document automatic feed apparatus 201 by paper eject rollers 205. During the conveyance at the constant speed, the document is illuminated by an illumination system 209 at a read position in the reading apparatus 202. Light having illuminated the document is reflected by reflective mirrors 210, 211 and 212 to enter an image reading unit 213. The image reading unit 213 is constituted by a lens, a CCD sensor serving as a photoelectric conversion element, a driver circuit for the CCD sensor, and so on.

As document read modes, there are a flow-reading mode and a fixed-reading mode. In the flow-reading mode, the document is read in a state where the document is conveyed at the constant speed while the illumination system 209 and the reflective mirrors 210, 211 and 212 are kept standstill. In the fixed-reading mode, the document is read in a state where the document is placed on a glass-made document plate 214 of the reading apparatus 202 while the illumination system 209 and the reflective mirrors 210, 211 and 212 are moved at a constant speed. Usually, a sheet-like document is read in the flow-reading mode and a document in bound form is read in the fixed-reading mode.

An image signal converted by the image reading unit 213 is processed in an image processing unit 102 (described later) and is reproduced on a transfer material (e.g., paper or a transparent film) by the image reproducing apparatus 301 per page.

The image signal is modulated into an optical signal by a semiconductor laser (not shown). A modulated laser beam is exposed to a photosensitive drum 309, which surface is uniformly charged by a primary charger 310, via an optical scanning apparatus 311 including a polygonal mirror and via reflective mirrors 312 and 313, thereby forming an electrostatic latent image. The electrostatic latent image is developed into a toner image by using a toner in a developing unit 314, and the toner image is transferred to the transfer material by a transfer charger 315.

The transfer material is stocked in a paper feed cassette 302 or 304. The transfer material in the paper feed cassette 302 is fed by a paper feed roller 303 and is conveyed by conveying rollers 306. The transfer material is then conveyed to a transfer position between the photosensitive drum 309 and the transfer charger 315 after being adjusted in timing with the toner image on the photosensitive drum 309 by a registration roller 308. On the other hand, the transfer material in the paper feed cassette 304 is fed by a paper feed roller 305 and is conveyed by conveying rollers 307 and 306. The transfer material is then conveyed to the transfer position after being adjusted in timing with the toner image on the photosensitive drum 309 by the registration roller 308.

The transfer material including the toner image transferred thereto is conveyed to a fusing unit 318 by a conveying belt 317. In the fusing unit 318, the transfer material is heated and pressed by a fusing roller 318*a* and a pressing roller 318*b* so that the toner image is fused and fixed to the surface of the transfer material. After the transfer of the toner image, the toner remaining on the surface of the photosensitive drum 309 without being transferred to the transfer material (i.e., the remaining toner) is removed by a cleaning apparatus 316 and the photosensitive drum 309 is used for a next image forming process.

When a simplex mode is set in the image forming apparatus 100 by the user, the transfer material having exited the fusing unit 318 is ejected externally (out of a main body of the image forming apparatus) through after-fusing paper eject rollers 319 and paper eject rollers 324. When a duplex mode is set, the transfer material is conveyed by reversing rollers 321 from the after-fusing paper eject rollers 319 into a reversing path 325 via conveying rollers 320.

By reversing the rotation of the reversing rollers 321 immediately after the trailing end of the transfer material has passed a merge point between the reversing path 325 and a duplex path 326, the transfer material is conveyed into the duplex path 326 in a reversed state where the front surface faces down. The transfer material having entered the duplex path 326 is conveyed by rollers 322 and 323 toward the registration roller 308 again via the conveying rollers 306. After being adjusted by the registration roller 308 in timing with a toner image to be formed on the rear surface of the transfer material, the toner image is transferred to the rear surface of the transfer material and is fused for fixing. Thereafter, the transfer material is ejected out of the main body of the image forming apparatus.

Additionally, in order to eject the transfer material having exited the fusing unit 318 externally in a state where the front surface faces up, the transfer material is temporarily advanced toward the conveying rollers 320. By reversing the rotation of the reversing rollers 320 immediately before the trailing end of the transfer material passes the conveying rollers 320, the transfer material is ejected externally by the paper ejection rollers 324.

Figure 2:
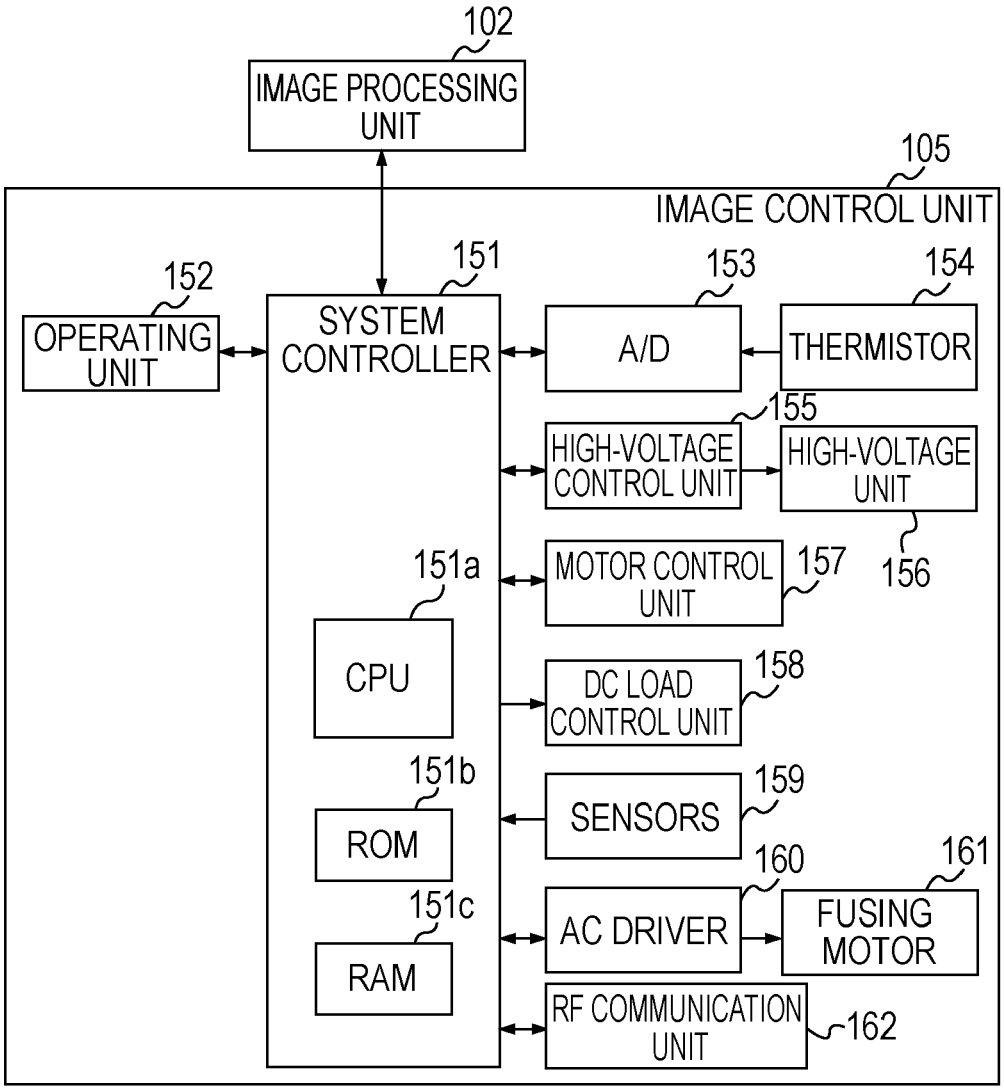
FIG. 2 is a block diagram of an image control unit according to an embodiment.

FIG. 2 is a block diagram of an image control unit 105 incorporated in the image forming apparatus 100 according to an embodiment. A system controller 151 controls all operations of the image forming apparatus 100 in a supervising manner. The system controller 151 primarily drives various loads in the image forming apparatus 100, collects and analyses information detected by sensors 159, and executes data exchange with respect to the image processing unit 102 and an operating unit 152 (i.e., a user interface).

The system controller 151 incorporates a CPU 151*a* and a ROM 151*b*. In accordance with programs stored in the ROM 151*b*, the CPU 151*a* executes various sequences related to predetermined image forming sequences.

The system controller 151 also incorporates a RAM 151*c* storing rewritable data that is required to be temporarily or permanently stored. The RAM 151*c* stores a high-voltage setting value applied to a high-voltage control unit 155, other various data, image forming information instructed from the operating unit 152, etc.

The system controller 151 controls the high-voltage control unit 155 and the image processing unit 102 so as to execute optimum image formation by sending specification setting value data for various units to the image processing unit 102 and by receiving signals from the various units, e.g., a document image density signal.

Further, the system controller 151 obtains information, such as a copy scaling factor and a density setting value set by the user, from the operating unit 152 and sends the status of the image forming apparatus 100 to the operating unit 152. For example, the system controller 151 sends, to the operating unit 152, the number of sheets on which images have been formed, information indicating whether the image formation is being executed, and data indicating the occurrence of a jam and the location of the jam to the user.

The operations of driving various loads in the image forming apparatus and collecting and analyzing information detected by sensors will be described next. Motors, DC loads such as clutches/solenoids, and sensors 159 such as photo-interrupters and microswitches are disposed at various positions within the image forming apparatus 100. In other words, the conveyance of the transfer material and the operations of various units are performed by driving the motors and the DC loads as required. The sensors 159 monitor the operations of the motors and the DC loads.

Based on signals from the sensors 159, the system controller 151 instructs a motor control unit 157 to control the motors and also instructs a DC load control unit 158 to operate the clutches/solenoids, thus smoothly performing the image forming operation.

Further, the system controller 151 sends various high-voltage control signals to the high-voltage control unit 155 for applying proper high voltages to various chargers, i.e., the primary charger 310 and the transfer charger 315, and to a developing cylinder 411 (see FIGS. 1 and 4) of the developing unit 314, which are examples of a high-voltage unit 156. Each of the fusing roller 318*a* and the pressing roller 318*b* in the fusing unit 318 includes a heater 161 arranged to heat the corresponding roller, and the heater 161 is ON/OFF-controlled by an AC driver 160.

Also, each of the fusing roller 318*a* and the pressing roller 318*b* includes a thermistor 154 arranged to measure the temperature of the corresponding roller. An A/D converter 153 converts changes of a resistance value of each thermistor 154, which are caused depending on temperature changes of the fusing roller 318*a* or the pressing roller 318*b*, to a voltage value and inputs the voltage value to the system controller 151 after conversion to a digital value. Based on thus-input temperature data, the system controller 151 controls the AC driver 160.

An RF communication unit 162 is used to perform radio communication with a toner container (described later) and includes communication equipment (such as an IC chip and an antenna). The radio communication can be practiced by a method of performing the communication with respect to a particular partner, or a method of broadcasting a request and receiving responses from all toner containers.

In the first exemplary embodiment, it is assumed that the radio communication is performed with respect to a particular toner container. Though described in detail later, the IC chip of the RFID tag incorporated in each toner container stores therein specific identification (ID) information. The image control unit 105 realizes the communication with a particular partner by designating the identification information of the particular partner. The identification information of the particular partner can be obtained by a method of broadcasting a request and receiving the identification information as a response.

Figure 3:
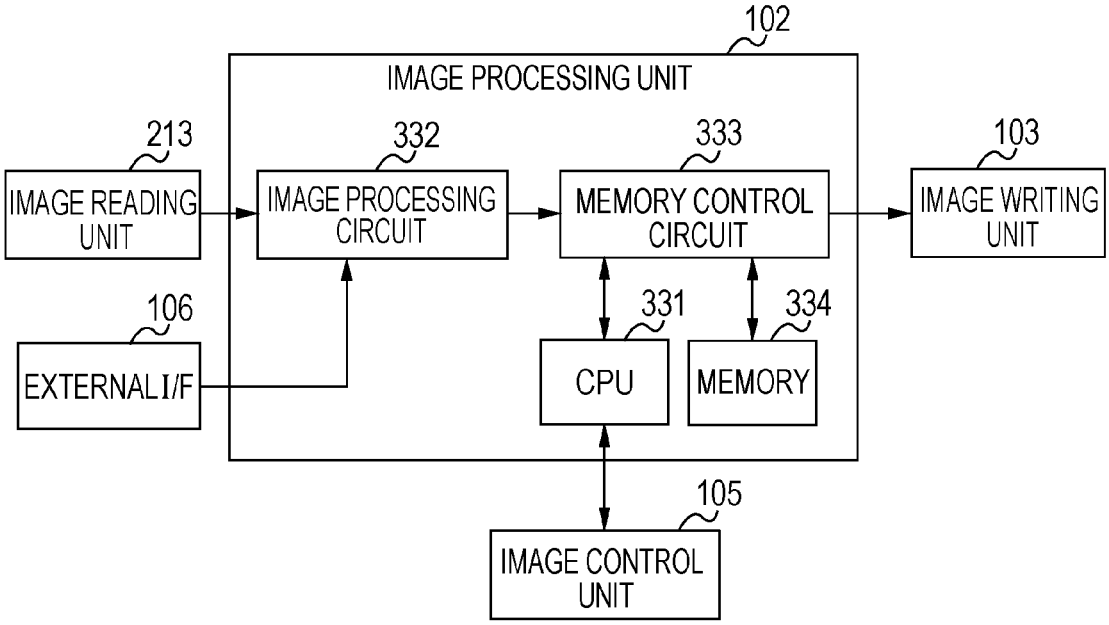
FIG. 3 is a block diagram of an image processing unit according to an embodiment.

FIG. 3 is a block diagram of the image processing unit 102 according to an embodiment. The image data read by the image reading unit 213 is input to the image processing unit 102 and is subjected to predetermined image processing in an image processing circuit 332. The processed image data is then input to a memory control circuit 333. Under control by the CPU 331, the memory control circuit 333 not only loads the input image data in a memory 334, but also reads image data to be used in the image formation from the memory 334 and outputs the read image data to an image writing unit 103.

The CPU 331 controls the memory control circuit 333 so that the input image data is loaded in the memory 334 and the image data loaded in the memory 334 is output to the image writing unit 103. Further, the CPU 331 reads the image data loaded in the memory 334, detects an image area in which the image data actually used in the image formation exists within image data of one page, and notifies the detected image area to the image control unit 105. The image processing circuit 332 receives data from an external I/F (interface) 106 in addition to the image data from the image reading unit 213.

Figure 4:
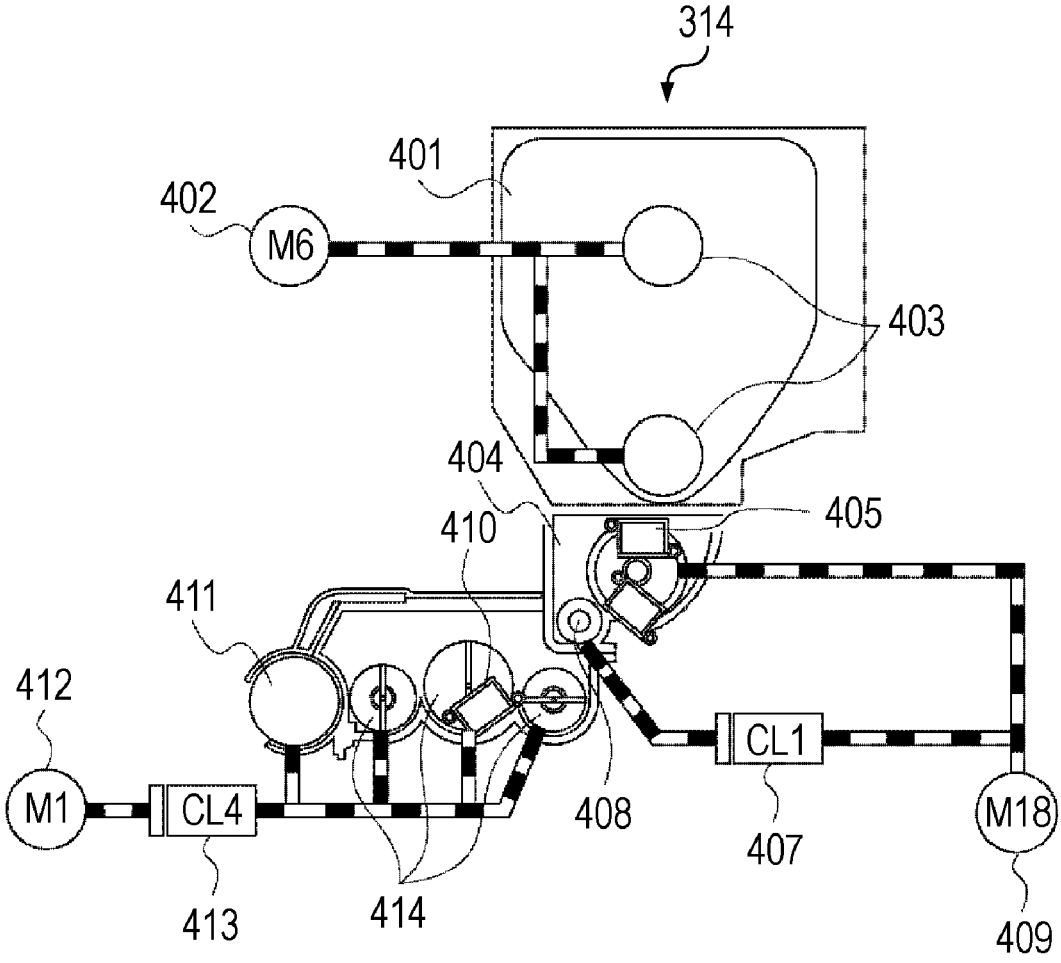
FIG. 4 is an explanatory view illustrating the construction of a developing unit according to an embodiment.

FIG. 4 is an explanatory view illustrating details of the developing unit 314 shown in FIG. 1 according to an embodiment. A toner container 401 is detachable type and the toner is supplied (replenished) from the toner container 401. Because the illustrated developing unit 314 includes a hopper 404, the toner can be supplied even during the operation of the developing unit 314. When a toner sensor 405 in the hopper 404 detects no presence of toner, a toner convey motor 402 in the toner container (cartridge) 401 is operated to drive toner conveying screws 403 such that the toner in the toner container 401 is supplied to the hopper 404.

Also, when a toner sensor 410 in the developing unit 314 detects no presence of toner, a convey motor 409 in the hopper 404 is driven to operate a magnet roller 408 in interlock with a magnet roller driving clutch 407, whereby the toner in the hopper 404 is supplied to the interior of the developing unit 314. The toner supplied to the interior of the developing unit 314 is introduced to the surface of the developing cylinder 411 by agitating members 414 which are driven by operation of a main motor 412 in interlock with a developing cylinder clutch 413. The above-described operation is controlled by the system controller 151.

Figure 5A:
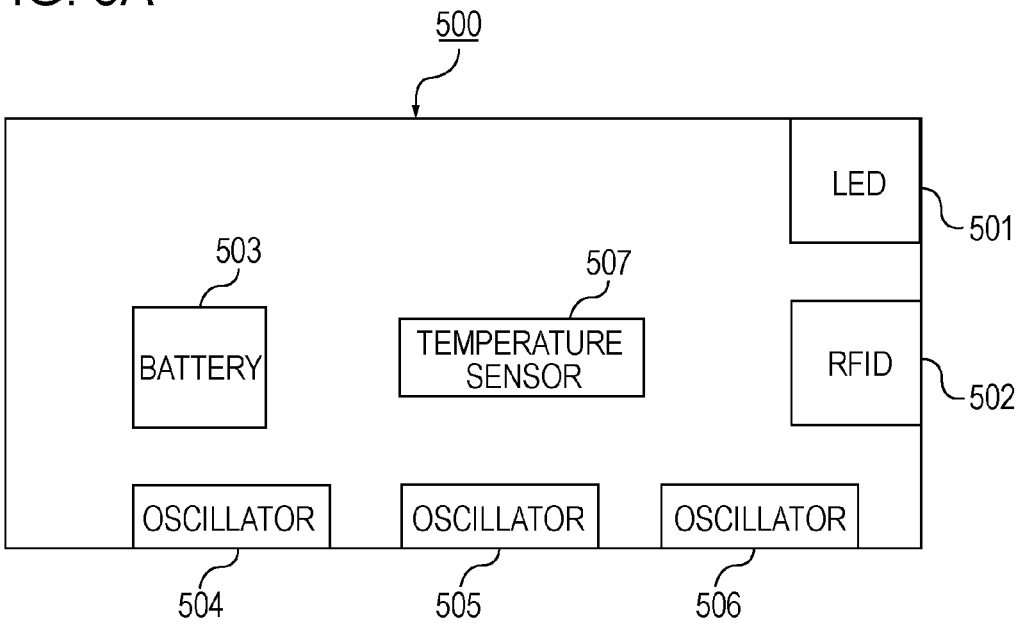
FIGS. 5A and 5B are each a block diagram illustrating the configuration of a toner container according to an embodiment.

FIG. 5A illustrates the internal configuration of a toner container 500 according to an embodiment. The toner container 500 includes a light emitting diode (LED) 501. The LED 501 is illuminated or blinked by electric power supplied from a battery 503 or electric power supplied via passive communication using an RFID tag 502. The RFID tag 502 is used to perform communication with the image control unit 105, and it incorporates a memory capable of being backed up and communication equipment (such as an IC chip and an antenna) similarly to the RF communication unit 162 of the image control unit 105.

Figure 5B:
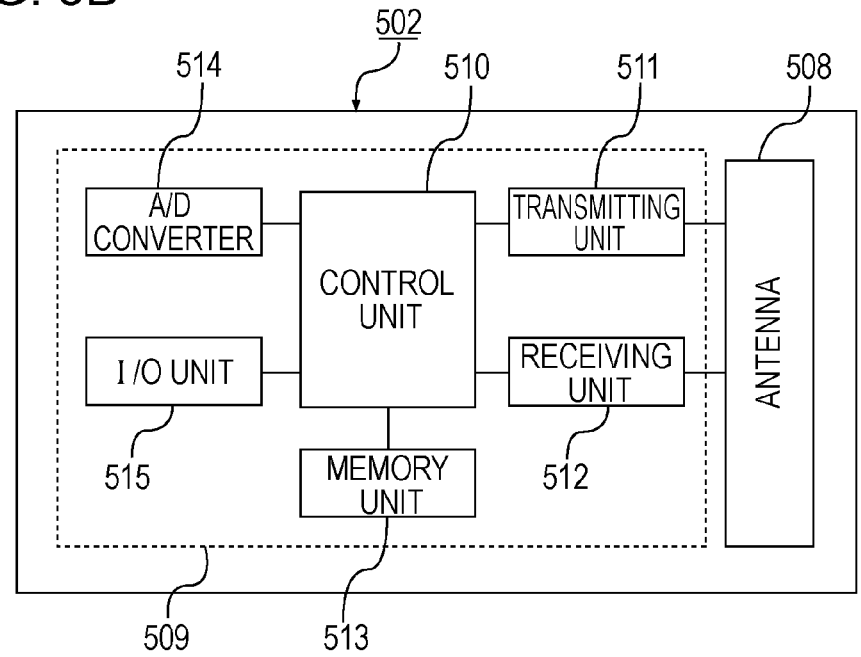

FIG. 5B is a block diagram of the RFID tag 502 according to an embodiment. The RFID tag 502 includes an antenna 508 and an IC chip 509. The RFID tag 502 is operated by electric power supplied from the battery 503 or electric power supplied via passive communication using the antenna 508. The IC chip 509 includes a control unit 510, a transmitting unit 511, a receiving unit 512, a memory unit 513, an A/D converter 514, and an I/O unit 515.

The control unit 510 controls the entirety of the IC chip 509. More specifically, the control unit 510 transmits data to the image control unit 105 via the transmitting unit 511 and the antenna 508. Also, the control unit 510 receives data from the image control unit 105 via the antenna 508 and the receiving unit 512. In addition, the control unit 510 controls read/write of data from and into the memory unit 513 which is constituted by a nonvolatile memory (e.g., a flash memory).

The A/D converter 514 is connected to a temperature sensor 507. The control unit 510 obtains temperature data through the A/D converter 514. The I/O unit 515 is connected to the LED 501 and oscillators 504, 505 and 506. The control unit 510 controls illumination of the LED 501 and oscillations of the oscillators 504, 505 and 506 through the I/O unit 515.

The LED 501 is illuminated by electric power supplied from the battery 503 or electric power supplied via passive communication using the RFID tag 502. The control unit 510 illuminates the LED 501 when it receives an illumination request from the image control unit 105. More specifically, when the image control unit 105 determines exhaustion of the toner in the toner container mounted to the image forming apparatus 100, it further determines whether there is a spare toner container containing the toner of the same color as that in the toner container in which the toner has been exhausted up. If the presence of the spare toner container containing the toner of the same color is determined, the image control unit 105 transmits an LED illumination request to the spare toner container containing the toner of the same color. This enables the user to easily confirm which one of the toner containers is to be replaced.

The oscillators 504, 505 and 506 are also oscillated by electric power supplied from the battery 503 or electric power supplied via passive communication using the RFID tag 502. The control unit 510 causes the plurality of oscillators 504, 505 and 506 to oscillate so that an uneven state of the toner in the toner container 500 is leveled into an even state.

Figure 6A:
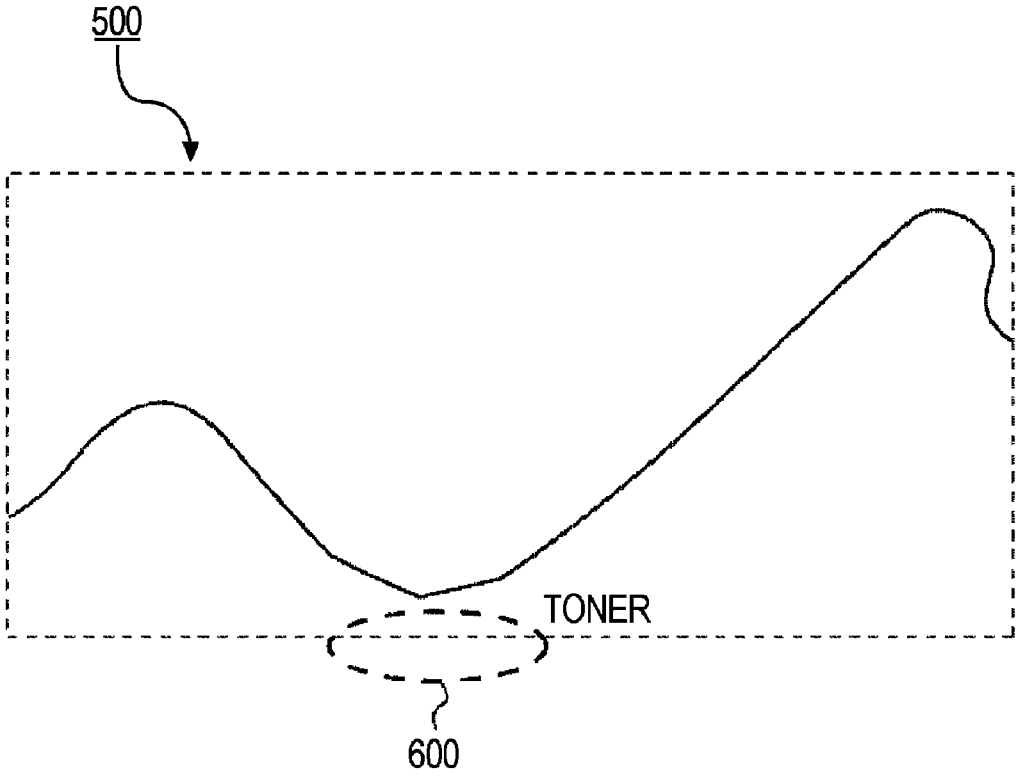
FIGS. 6A and 6B each illustrate a toner state in the toner container according to an embodiment.
Figure 6B:
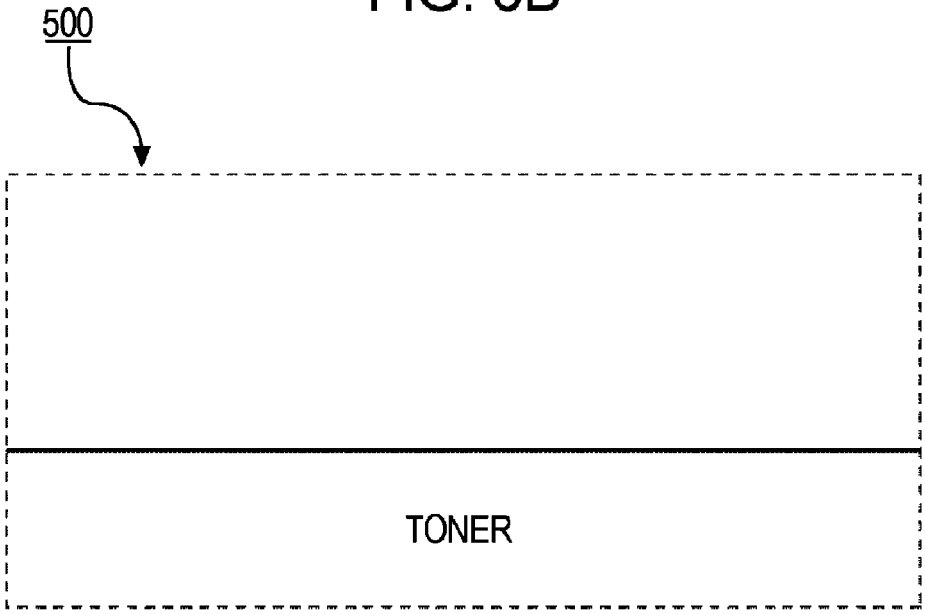

FIGS. 6A and 6B illustrate respectively the uneven state and the leveled even state of the toner according to an embodiment. As shown in FIG. 6A, when the toner container 500 is set to the developing unit 314 with the toner being in the uneven state, there arises a problem that the toner is not properly supplied. More specifically, when a toner supply port is formed at a position indicated by 600 in FIG. 6A, supply of the toner is performed in a state where the toner is hardly present near the toner supply port, and the toner cannot be stably supplied in spite of the rotation of the toner conveying screws 403. Also, when the toner is in a state cohering and aggregating in the toner container, the toner cannot be stably supplied.

By operating the plurality of oscillators 504, 505 and 506 to oscillate in the above-described state, the toner in the toner container 500 can be leveled into the even state, as shown in FIG. 6B, so that the toner can be properly supplied. The plurality of oscillators 504, 505 and 506 are each constituted by a piezoelectric oscillator and operated in an ultrasonic band (about 2-10 MHz). Minute oscillations in an ultrasonic band are not audible by human ears and are effective in separating the toner having cohered and aggregated in the toner container, thus leveling the toner into the even state.

The RFID tag 502 transmits, to the image control unit 105, the identification information stored in the internal memory unit 513 and the temperature information detected by the temperature sensor 507. The RF communication unit 162 in the image control unit 105 includes the antenna and the IC chip as described above, and it receives the identification information and the temperature information which are transmitted from the RFID tag 502 of the toner container 500. The received identification information and temperature information are sent to the system controller 151.

When the identification information and the temperature information are sent to the CPU 151*a*, the CPU 151*a* reads a temperature condition corresponding to the sent identification information from the RAM 151*c*. Then, the CPU 151*a* determines whether the sent temperature information satisfies the temperature condition read from the RAM 151*c*.

If the determination result indicates that the sent temperature information satisfies the temperature condition, the CPU 151*a* generates a signal for stopping the oscillators 504, 505 and 506 and transmits the stop signal to the toner container 500 along with the identification information of the toner container 500 which is the destination of the transmission. On the other hand, if the sent temperature information does not satisfy the temperature condition, the CPU 151*a* generates a signal for driving the oscillators 504, 505 and 506 and transmits the driving signal to the toner container 500 along with the identification information of the toner container 500 which is the destination of the transmission.

Figure 7:
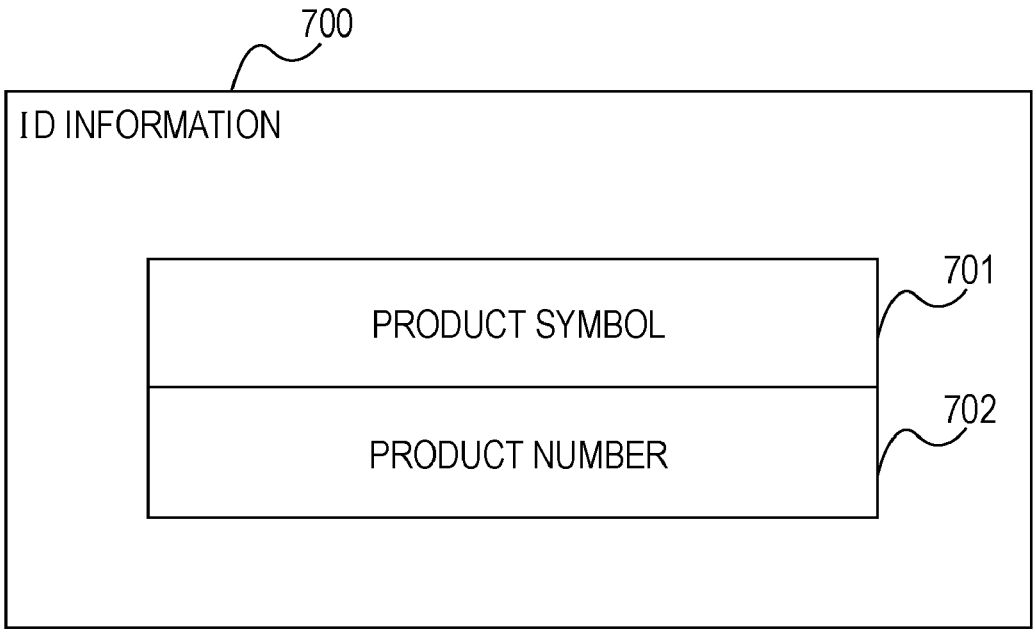
FIG. 7 illustrates details of identification (ID) information according to an embodiment.

More specifically, identification information 700 is given, by way of example, as shown in FIG. 7 and is stored in the memory unit 513 incorporated in the RFID tag 502 of the toner container 500. The identification information 700 comprises a product symbol 701 and a product number 702. The product symbol 701 is a symbol indicating the kind of toner and is assigned as a symbol which differs depending on different colors (yellow, magenta, cyan, and black) even when the toner is used in the same image forming apparatus. The product number 702 is a number which is uniquely assigned to each toner container.

Figure 8:
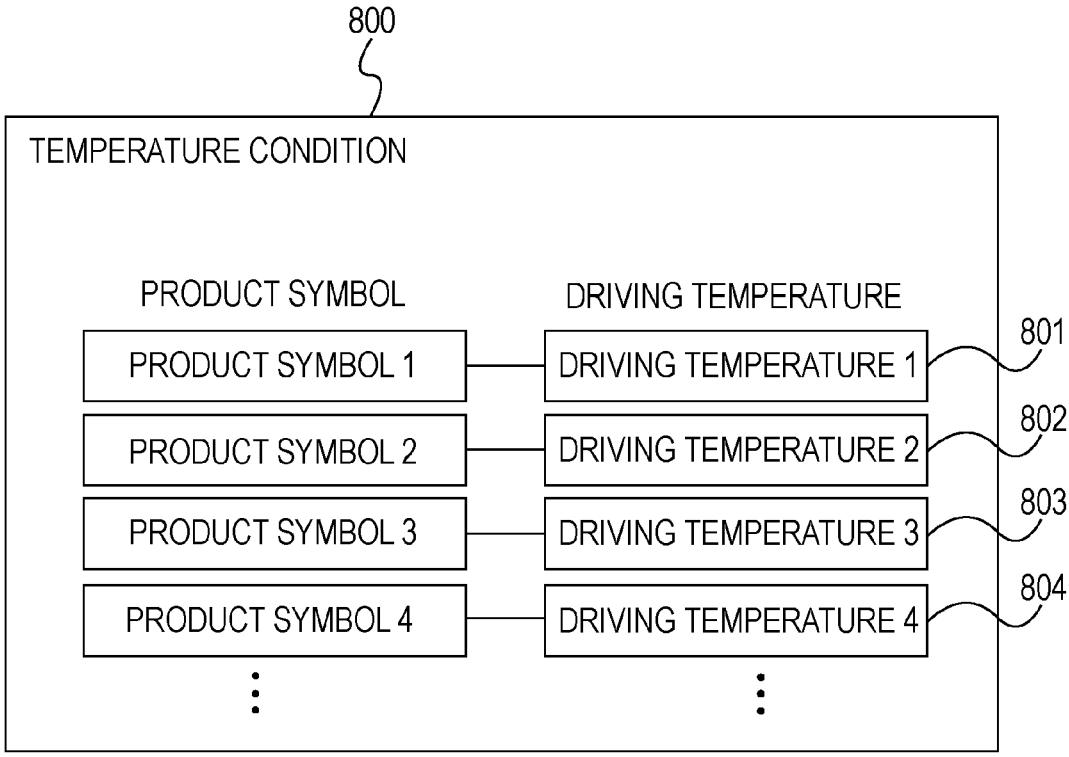
FIG. 8 illustrates details of temperature conditions table stored in the image forming apparatus according to an embodiment.

The RAM 151*c* stores information as shown in FIG. 8. A temperature condition 800 is prepared such that, as denoted by 801-804 in FIG. 8, product symbols indicating the kinds of toners and driving temperatures indicating temperatures at which the driving of the oscillators 504, 505 and 506 is started are stored in pairs. The driving temperatures are each set lower than or about the temperature at which the toner starts to cohere and aggregate. The RAM 151*c* stores those pairs of information in number corresponding to the kinds of toners required.

Figure 9A:
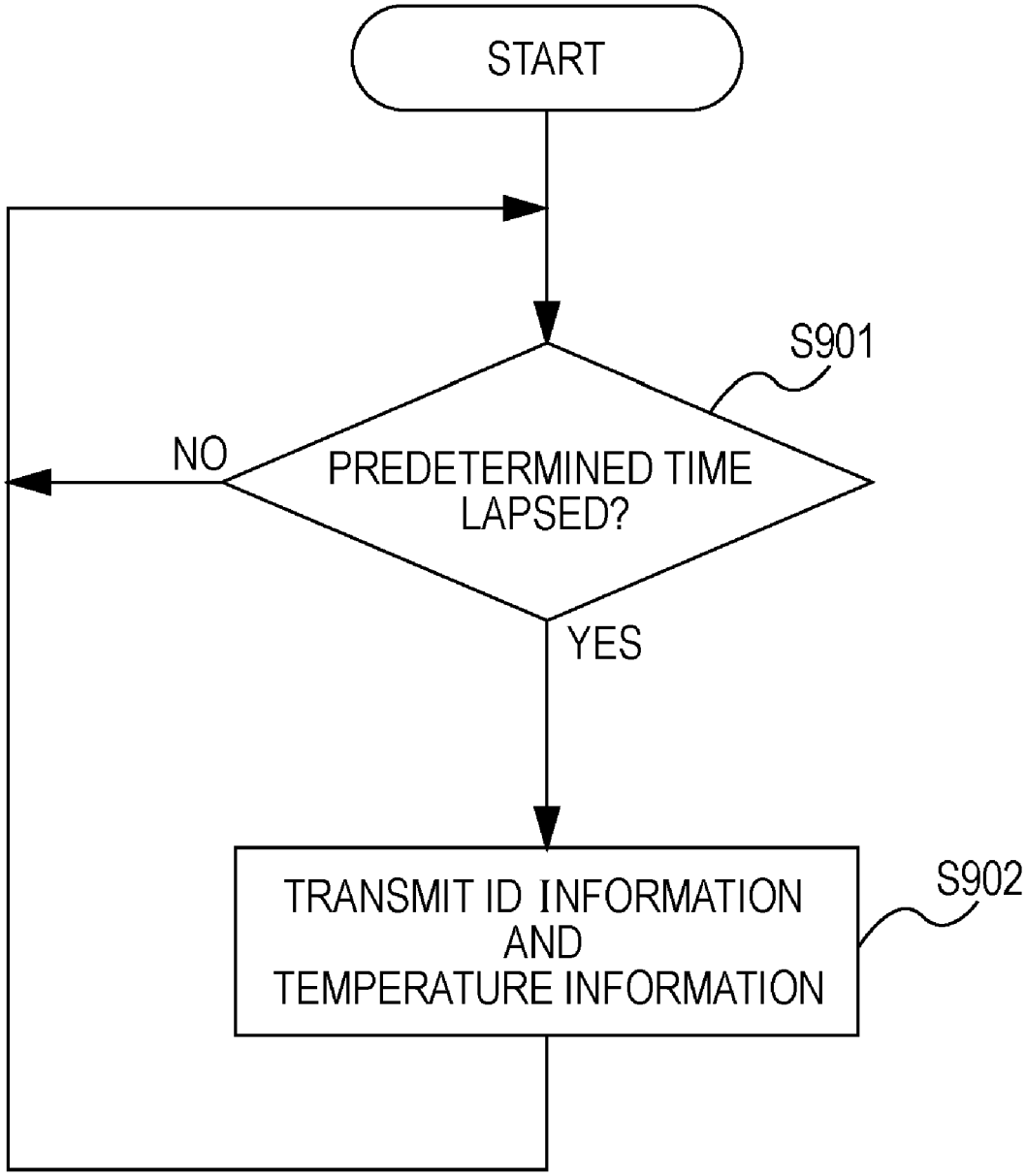
FIGS. 9A and 9B are each a flowchart of the operation of an RFID tag of the toner container according to an embodiment.
Figure 9B:
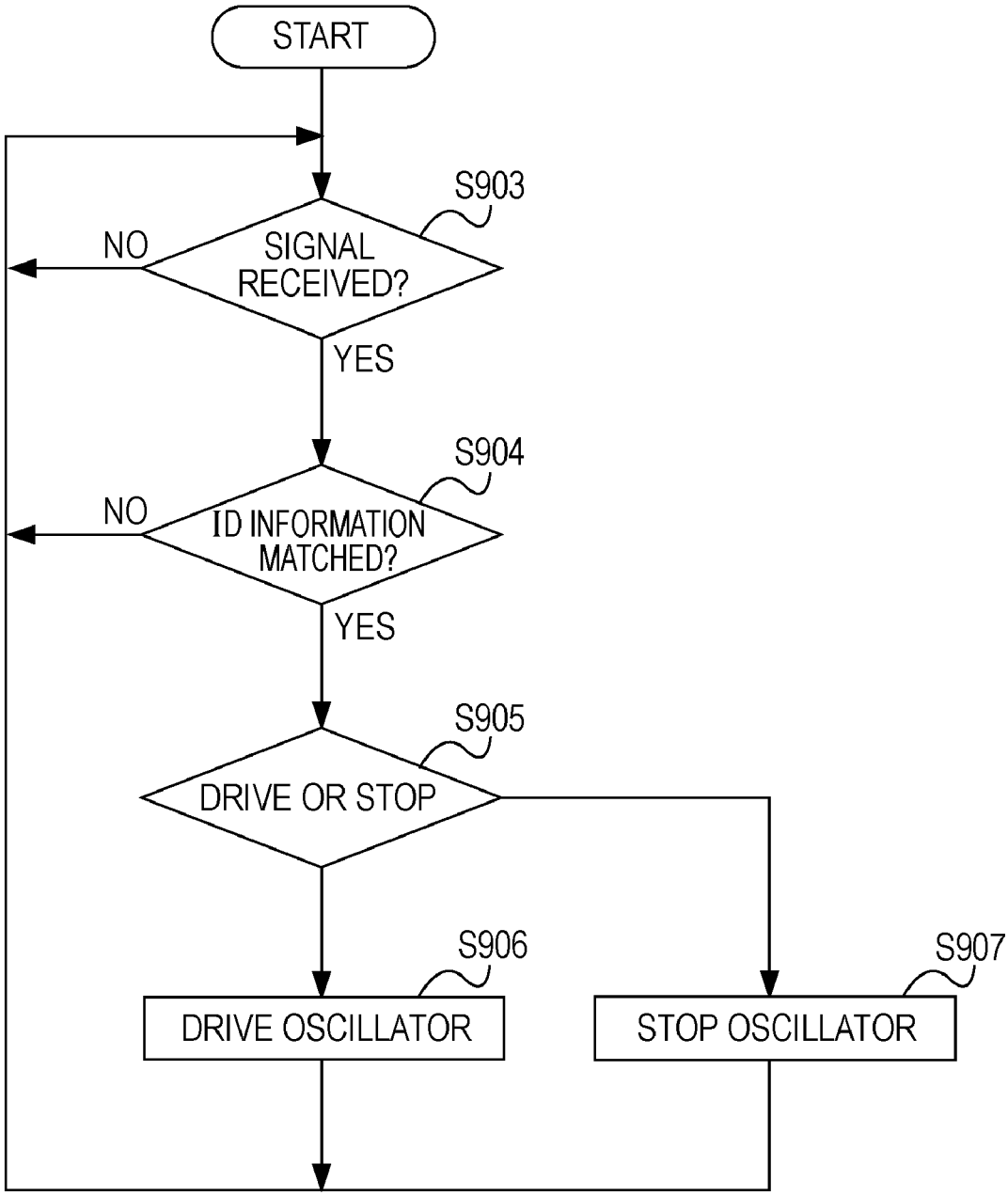

FIGS. 9A and 9B are each a flowchart of the operation of the RFID tag 502 of the toner container 500 according to an embodiment. FIG. 9A illustrates a flow of the operation for transmitting the identification information and the temperature information to the image control unit 105, and FIG. 9B illustrates a flow of the operation for receiving the identification information and a driving signal from the image control unit 105.

In the transmission flow of FIG. 9A, the RFID tag 502 of the toner container 500 determines whether a certain time has lapsed (S901). If the certain time has lapsed, the RFID tag 502 transmits, to the image control unit 105, the identification information (including the product symbol 701 and the product number 702) and the temperature information detected by the temperature sensor 507 (S902). Thereafter, the processing is returned to step S901.

In the reception flow of FIG. 9B, the RFID tag 502 first determines whether it has received the signal from the image control unit 105 (S903). If the RFID tag 502 determines that it has received the signal from the image control unit 105, the RFID tag 502 further determines whether the received identification information is matched with its own identification information stored in the IC chip which is incorporated in the RFID tag 502 (S904).

If the match of the identification information is determined, the RFID tag 502 determines whether the received signal is a driving signal to drive the oscillators 504, 505 and 506 or a stop signal (S905). If the received signal is the driving signal, the RFID tag 502 drives the oscillators 504, 505 and 506 (S906). Thereafter, the processing is returned to step S901. If the received signal is the stop signal, the RFID tag 502 stops the oscillators 504, 505 and 506 (S907). Thereafter, the processing is returned to step S901.

Figure 10:
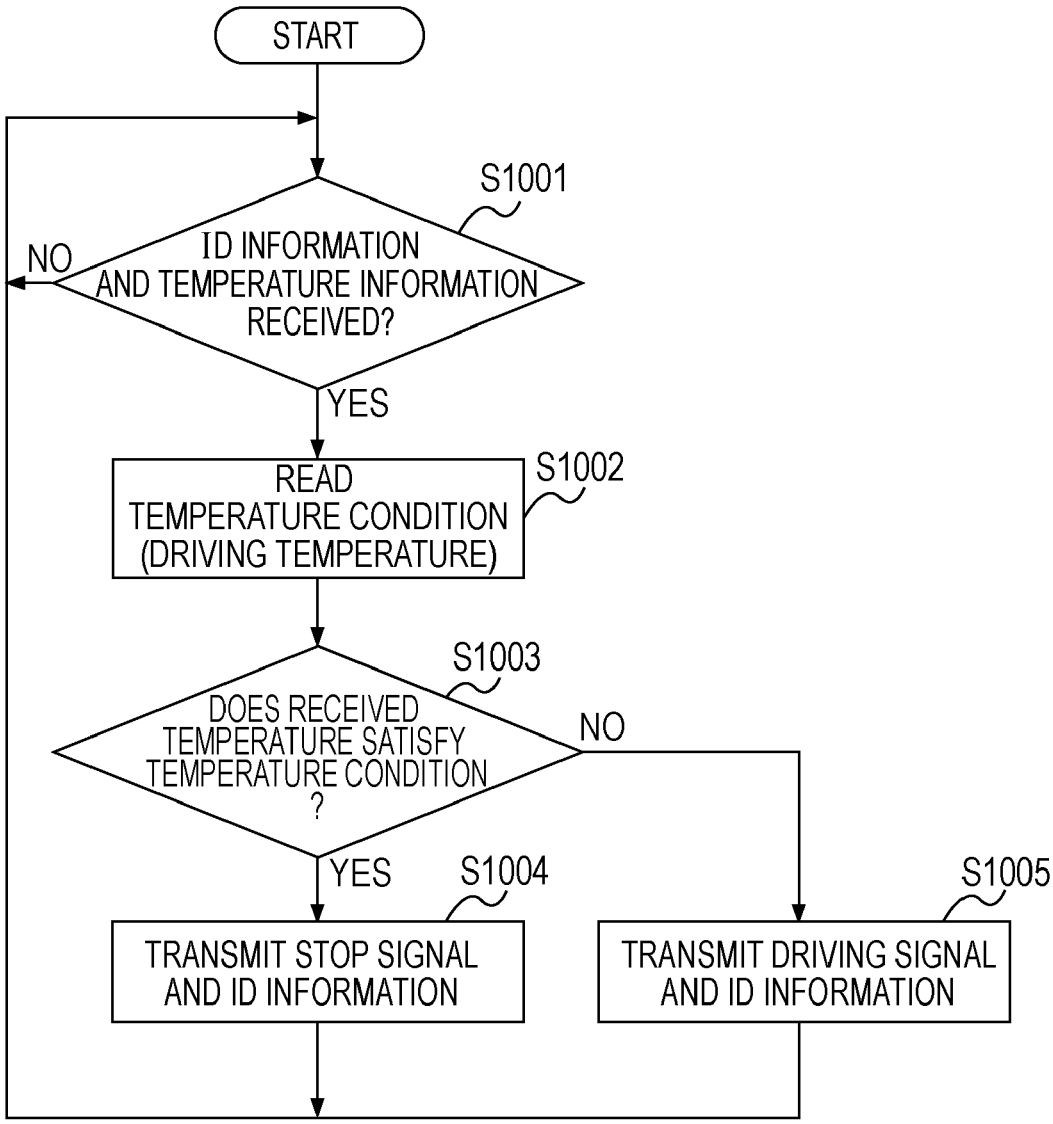
FIG. 10 is a flowchart of the operation of the image control unit according to an embodiment.

FIG. 10 is a flowchart of the operation of the image control unit 105 according to an embodiment. The image control unit 105 determines whether the identification information (including the product symbol 701 and the product number 702) and the temperature information are received from the RFID tag 502 of the toner container 500 (S1001). If the identification information and the temperature information are received, the image control unit 105 reads the temperature condition corresponding to the product symbol from the RAM 151*c* (S1002). For example, when the product symbol included in the received identification information is "product symbol 1", the image control unit 105 reads, as the driving temperature, "driving temperature 1" (801 in FIG. 8).

Then, the image control unit 105 determines whether the received temperature information satisfies the temperature condition read from the RAM 151*c* (S1003). If the image control unit 105 determines that the temperature condition is satisfied, i.e., if the received temperature information is lower than the driving temperature, the image control unit 105 transmits the stop signal to stop the oscillators along with the identification information (S1004). Thereafter, the processing is returned to step S1001.

If the image control unit 105 determines in step S1003 that the temperature condition is not satisfied, i.e., if the received temperature information is not lower than the driving temperature, the image control unit 105 transmits the driving signal to drive the oscillators along with the identification information (S1005). Thereafter, the processing is returned to step S1001.

According to the first exemplary embodiment, as described above, since the toner container 500 is oscillated in a state not mounted to the image forming apparatus 100, a downtime can be reduced which is caused with the toner supply operation when the toner container 500 is mounted to the image forming apparatus 100. Further, the operation of applying oscillation to the toner container 500 can prevent the toner from cohering and aggregating in the not-yet-mounted (spare) toner container.

Second Exemplary Embodiment

A second exemplary embodiment of the present invention will be described next with reference to the drawings. In the second exemplary embodiment, when the temperature at the place where the toner container is stored (e.g., a storage box) is so high as to cause cohesion and aggregation of the toner, an alarm is displayed in a liquid crystal display portion of the operating unit 152 to notify the user of such a situation. Note that it is not always required to prepare the liquid crystal display portion, and the alarm can be displayed by some other more cost-effective method of, for example, illuminating an LED lamp.

When the identification information and the temperature information are sent to the CPU 151*a*, the CPU 151*a* reads the temperature condition corresponding to the sent identification information from the RAM 151*c*. If the CPU 151*a* determines that the sent temperature information does not satisfy the temperature condition, the CPU 151*a* displays an alarm screen, shown in FIG. 11, in the liquid crystal display portion of the operating unit 152.

Figure 12:
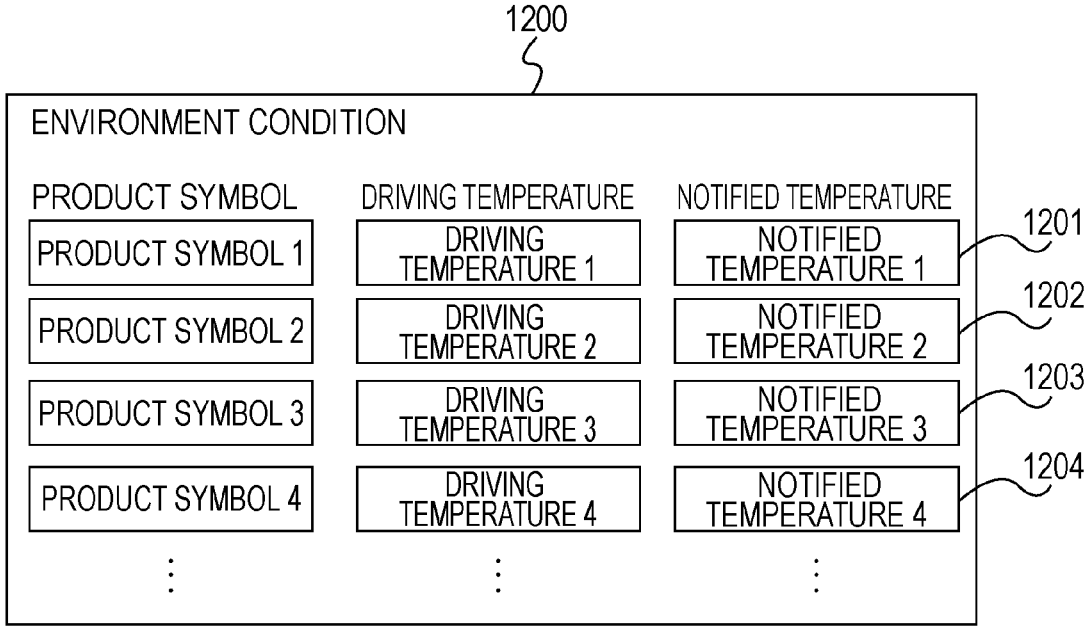
FIG. 12 illustrates details of temperature conditions table stored in the image forming apparatus according to an embodiment.

The RAM 151*c* stores a temperature (environment) condition 1200 as shown in FIG. 12. The temperature condition in the second exemplary embodiment is prepared by adding information of alarm issuing temperatures 1201-1204 to the combinations of the product symbols and the driving temperatures shown in FIG. 8. The alarm issuing temperatures 1201-1204 are set to values higher than the driving temperatures 801-804, respectively, but lower than the temperature at which the toner starts to cohere and aggregates. The RAM 151*c* stores those sets of information in number corresponding to the kinds of toners required.

Figure 13:
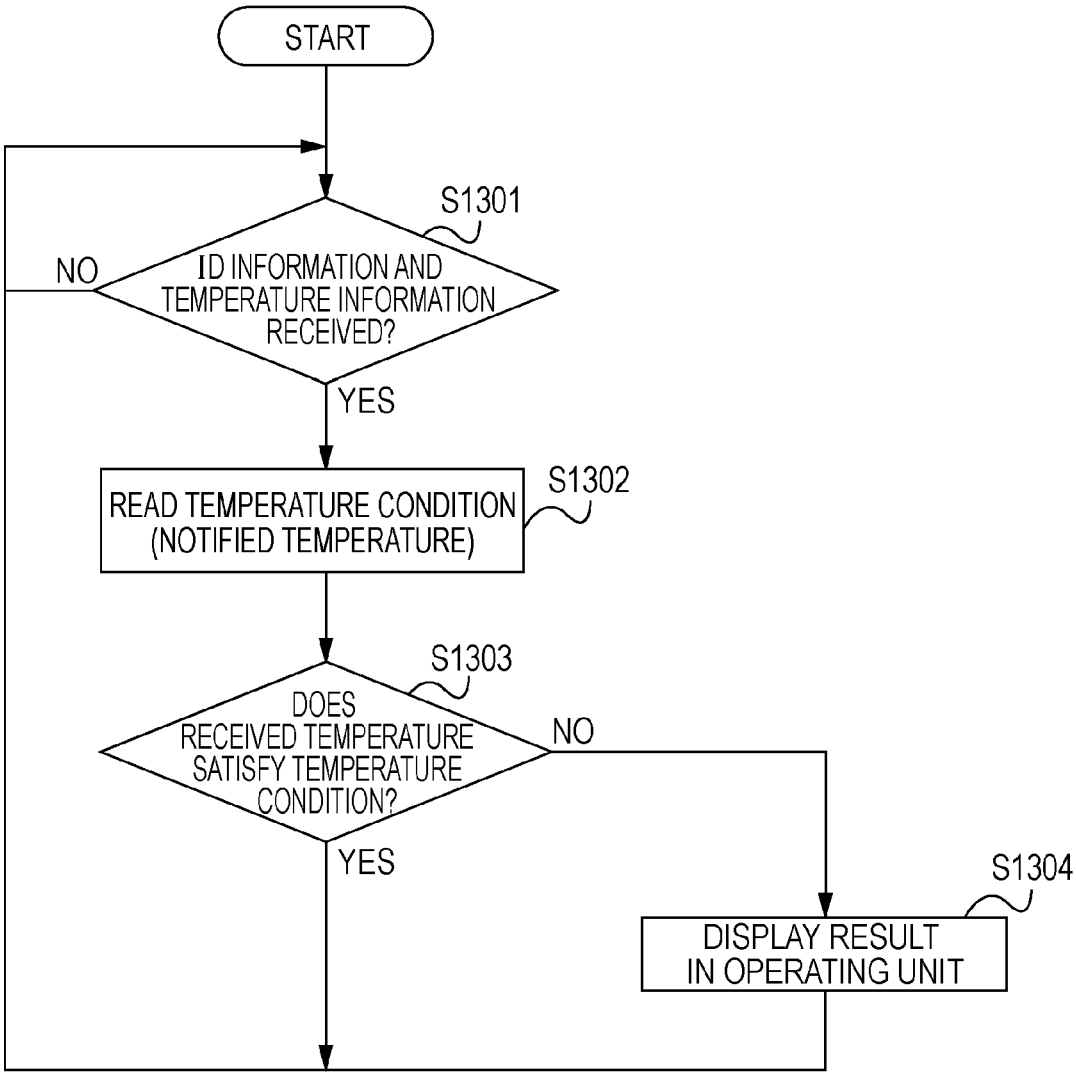
FIG. 13 is a flowchart of the operation of the image control unit according to an embodiment.

FIG. 13 is a flowchart of the operation of the image control unit 105 according to the second exemplary embodiment. Note that, in parallel to the control shown in the flowchart of FIG. 13, the image control unit 105 executes the above-described control shown in the flowchart of FIG. 10.

The image control unit 105 determines whether the identification information (including the product symbol 701 and the product number 702) and the temperature information are received from the RFID tag 502 of the toner container 500 (S1301). If the identification information and the temperature information are received, the image control unit 105 reads the temperature condition corresponding to the product symbol from the RAM 151*c* (S1302). For example, when the product symbol included in the received identification information is "product symbol 1", the image control unit 105 reads, as the alarm issuing temperature, "alarm issuing temperature 1" (1201 in FIG. 12).

Then, the image control unit 105 determines whether the received temperature information satisfies the temperature condition read from the RAM 151*c* (S1303). If the image control unit 105 determines that the temperature condition is satisfied, i.e., if the received temperature information is lower than the alarm issuing temperature, the processing is immediately returned to step S1301. If the image control unit 105 determines in step S1303 that the temperature condition is not satisfied, i.e., if the received temperature information is not lower than the alarm issuing temperature, the alarm screen, shown in FIG. 11, is displayed in the liquid crystal display portion of the operating unit 152 (S1304).

Thus, according to the second exemplary embodiment, as with the first exemplary embodiment, a downtime can be reduced which is caused when the toner container 500 is mounted to the image forming apparatus 100. Further, the toner can be prevented from cohering and aggregating in the not-yet-mounted (spare) toner container.

Further, by displaying the alarm shown in FIG. 11, the user can be notified of an improper condition of the toner container 500, i.e., the necessity of keeping the temperature at the storage place (storage box) for the toner container 500 in a proper range. As a result, the toner can be prevented from cohering and aggregating in the toner container 500 which is stored at the storage place.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-341128 filed Dec. 19, 2006, which is hereby incorporated by reference herein in its entirety.

What is claimed is:

1. An image forming apparatus to which a developer container is detachably mountable, the image forming apparatus comprising:

a receiving unit configured to receive, via wireless communication, temperature information detected by a temperature detecting unit, which is disposed in the developer container, from the developer container in a state not mounted to the image forming apparatus;

a determining unit configured to determine, based on the temperature information received by the receiving unit, whether an oscillating unit disposed in the developer container is to be oscillated; and a transmitting unit configured to transmit a signal for oscillating the oscillating unit to the developer container via wireless communication based on a determination result of the determining unit indicating that the oscillating unit is to be oscillated.

2. The image forming apparatus according to claim 1, wherein the receiving unit receives identification information of the developer container along with the temperature information.

3. The image forming apparatus according to claim 2, further comprising a storage unit configured to store, in a corresponding relation to the identification information of the developer container, a driving temperature which serves as a reference for determining whether the oscillating unit disposed in the developer container is to be oscillated, wherein the determining unit obtains, from the storage unit, the driving temperature corresponding to the identification information received by the receiving unit, compares the driving temperature obtained from the storage unit with the temperature information received by the receiving unit, and determines whether the oscillating unit is to be oscillated.

4. The image forming apparatus according to claim 1, wherein the receiving unit comprises a radio frequency receiver capable of receiving the temperature information via radio frequency signals, and wherein the transmitting unit comprises a radio frequency transmitter capable of transmitting the signal for oscillating the oscillating unit via radio frequency signals.

5. An image forming apparatus to which a developer container is detachably mountable, the image forming apparatus comprising:

an operating unit configured to receive an operation instruction from a user;

a receiving unit configured to receive, via wireless communication, temperature information detected by a temperature detecting unit, which is disposed in the developer container, from the developer container in a state not mounted to the image forming apparatus;

a determining unit configured to determine, based on the temperature information received by the receiving unit, whether an alarm is to be displayed in the operating unit; and a display control unit configured to display the alarm in the operating unit based on a determination result of the determining unit indicating that the alarm is to be displayed in the operating unit.

6. The image forming apparatus according to claim 5, wherein the alarm comprises a message displayed in the operating unit including information relating to temperature of the developer container.

7. The image forming apparatus according to claim 5, wherein the receiving unit receives identification information of the developer container along with the temperature information.

8. The image forming apparatus according to claim 7, further comprising a storage unit configured to store, in a corresponding relation to the identification information of the developer container, an alarm issuing temperature which serves as a reference for determining whether the alarm is to be displayed in the operating unit, wherein the determining unit obtains, from the storage unit, the alarm issuing temperature corresponding to the identification information received by the receiving unit, compares the alarm issuing temperature obtained from the storage unit with the temperature information received by the receiving unit, and determines whether the alarm is to be displayed in the operating unit.

9. The image forming apparatus according to claim 5, wherein the receiving unit comprises a radio frequency receiver capable of receiving the temperature information via radio frequency signals.

10. A developer container detachably mountable to an image forming apparatus, the developer container comprising:

a temperature detecting unit arranged to detect a temperature;

a transmitting unit configured to transmit, to the image forming apparatus via wireless communication, temperature information detected by the temperature detecting unit in a state that the developer container is not mounted to the image forming apparatus an oscillating unit arranged to oscillate the developer container; and a receiving unit configured to receive, from the image forming apparatus via wireless communication, a signal for oscillating the oscillating unit in a state that the developer container is not mounted to the image forming apparatus, wherein the oscillating unit oscillates the developer container in response to the signal for oscillating the oscillating unit received from the image forming apparatus.

11. The developer container according to claim 10, wherein the transmitting unit comprises a radio frequency transmitter capable of transmitting the temperature information via radio frequency signals, and wherein the receiving unit comprises a radio frequency receiver capable of receiving the signal for oscillating the oscillating unit via radio frequency signals.

* * * * *